US005430780A

United States Patent [19]

Takeda et al.

[11] Patent Number: 5,430,780

[45] Date of Patent: Jul. 4, 1995

[54] RESET MECHANISM OF COUNTER FOR COUNTING NUMBER OF TIMES OF IMAGE FORMATION

[75] Inventors: Hideki Takeda; Susumu Komaki; Katsuyuki Teranishi, all of Osaka, Japan

[73] Assignee: Mita Industrial Co., Ltd., Japan

[21] Appl. No.: 165,158

[22] Filed: Dec. 10, 1993

[30] Foreign Application Priority Data

Dec. 24, 1992 [JP] Japan ..... 4-344823

[51] Int. Cl.[6] ..... G06M 1/08

[52] U.S. Cl. ..... 377/15; 377/88

[58] Field of Search ..... 377/15, 2, 88

[56] References Cited

U.S. PATENT DOCUMENTS 4,516,498 5/1985 Mistyurik ..... 377/15
4,890,306 12/1989 Noda ..... 377/15
4,974,238 11/1990 Kobayashi et al. ..... 377/15

FOREIGN PATENT DOCUMENTS 4-29159 1/1992 Japan .

OTHER PUBLICATIONS

English Language Abstract of 4-29159.

*Primary Examiner*—John S. Heyman
*Attorney, Agent, or Firm*—Beveridge, DeGrandi, Weilacher & Young

[57] ABSTRACT

A reset mechanism of a counter for counting the number of times of image formation is mounted on an image forming apparatus. The image forming apparatus includes a unit constituting at least a part of an image forming section which is detachably mounted on a predetermined portion of the main body of the image forming apparatus, a driving mechanism for driving the unit, and a counter for counting the number of times of image formation for reporting the time for replacement of the unit. The reset mechanism has a reset switch provided for on the main body for resetting the counter, and an operating member which is provided for on the unit for operating the reset switch. If a unit which has not been used is mounted on the main body, the operating member which is previously set in the operating position resets the reset switch. If the unit is initially driven by the driving mechanism, the operating member is moved to the operating position by the driving mechanism, so that the connection between the operating member and the driving mechanism is released. The operating member which is moved to the non-operating position can be held in the non-operating position, so that the unit never operates the reset switch.

12 Claims, 5 Drawing Sheets

RESET MECHANISM OF COUNTER FOR COUNTING NUMBER OF TIMES OF IMAGE FORMATION

CROSS REFERENCE TO RELATED APPLICATION

This application claims priority benefit under 35 USC section 119 of Japanese Patent Application Serial No. 4-344823, filed Dec. 24, 1992, the disclosure of which is incorporated by reference.

BACKGROUND OF THE INVENTION

1. Field of the invention

The present invention relates to a reset mechanism of a counter, for counting the number of times of image formation which is mounted on an image forming apparatus such as an electrostatic process copying machine, a facsimile or a laser beam printer. The reset mechanism resets, at a required time, the counter for counting the number of times of image formation and for reporting the time when maintenance is required.

2. Description of the Related Art

There has been conventionally provided an image forming apparatus so constructed as to bring at least two elements (for example, a photosensitive drum, a cleaning device and a charger) in an image forming section into a unit so that maintenance, such as replacement, can be carried out by integrally removing the unit in cases such as a case where the lifetime of the photosensitive drum is over and a case where the cleaning device is full of waste toner.

There has been also provided an image forming apparatus in which a counter, for counting the number of times of image formation by a photosensitive drum and the like, is provided as means for reporting the time for replacement of such a unit, to display a message or the like issuing an instruction to replace the unit if a value counted by the counter reaches not less than a predetermined value.

In this case, a worker or the like resets the counter to zero after replacing the unit with a new unit, to calculate the next time for replacement of the unit. However, resetting work of the counter is performed manually by the worker. In some cases, the worker may erroneously reset the counter when no reset is required or may forget to reset the counter when reset is required. Therefore, it is impossible to accurately grasp the time for replacement.

In order to solve such a problem, there is provided an image forming apparatus so adapted as to automatically reset a counter in synchronism with the mounting of a unit. In this image forming apparatus, there is no problem if the unit is replaced with a new unit. However, there is a problem when a unit which has not yet been used such a number of times that replacement is required (a unit which has been used, for example, 15,000 times in a case where such a number of times of image formation that replacement is required is 20,000) is removed once and is mounted again. Specifically, even when an old unit which has been used only 15,000 times is mounted again, the counter is reset, so that the unit is used 35,000 times before a message reporting the next time for replacement is issued. Therefore, the time for replacement of the unit greatly slips.

SUMMARY OF THE INVENTION

The present invention has been made in view of the above described problems and to provide a reset mechanism of a counter for counting the number of times of image formation which can reset the counter only when a new unit is mounted and can accurately grasp the time for replacement.

According to an embodiment of the present invention for attaining the above described object, there is provided a reset mechanism of a counter for counting the number of times of image formation which is mounted on an image forming apparatus. The image forming apparatus includes a unit constituting at least a part of an image forming section for image formation which is detachably mounted on a predetermined portion of the main body of the image forming apparatus. The image forming apparatus also has a driving mechanism for driving the unit, and a counter for counting the number of times of image formation and for reporting the time for replacement of the unit. The reset mechanism for resetting the counter in relation to the unit comprises a reset switch provided for on the main body of the image forming apparatus, and an operating member which is provided for on the unit. The operation member is movable from an operating position, where it operates the reset switch when a mounting operation of the unit is performed, to a non-operating position where the interference between the operating member and the reset switch is avoided. The operating member is set on the operating position when the unit is not used. The reset mechanism also includes means for holding, in the non-operating position, the operating member which has been moved to the non-operating position, the operating member being so connected to the driving mechanism that it is moved to the non-operating position by the driving mechanism at the time of initially driving the unit by the driving mechanism. The connection is then released so as not to be restorable in the operating position.

According to the above described embodiment, if a unit which has not been used is mounted on the main body of the image forming apparatus, the operating member in the operating position resets the reset switch. When the unit is initially driven by the driving mechanism, the operating member is moved to the non-operating position by the driving mechanism, so that the connection between the operating member and the driving mechanism is released. The operating member which is moved to the non-operating position is then held in the non-operating position, so that the unit never operates the reset switch again. Even if a unit which has not been used such a number of times that replacement is required is removed once for maintenance and is mounted again, therefore, the counter can continuously count the number of times of image formation in addition to the number of times of image formation counted before the removal, thereby making it possible to accurately recognize the time for replacement of the unit. Therefore, it is possible to prevent the unit which has been used such a number of times that replacement is required from being used for a longer time than necessary.

According to another embodiment of the present invention, there is provided a reset mechanism of a counter for counting the number of times of image formation which is mounted on an image forming apparatus. The image forming apparatus includes a unit constituting at least a part of an image forming section for image formation which is detachably mounted on a predetermined portion of the main body of the image forming apparatus. The image forming apparatus also includes a driving the unit, and a counter for counting the number of times of image formation for reporting the time for replacement of the unit. The reset mechanism for resetting the counter in relation to the unit comprises a reset switch provided for on the main body of the image forming apparatus, and an operating member which is provided for on the unit. The operating member is movable from its original position to a non-operating position where interference between the operating member and the reset switch is avoided, through an operating position where it operates the reset switch. The operating member is set on the original position when the unit is not used. The reset mechanism also includes means for holding the operator member in the non-operating position after the operating member is moved to the non-operating position. The operating member is so connected to the driving mechanism that it is moved from the original position to the non-operating position by the driving mechanism at the time of initially driving the unit and the connection is then released so as not to be restorable to the operating position.

According to the present embodiment, if a unit which has not been used is mounted on the main body of the image forming apparatus, when the unit is initially driven, the operating member passes through the operating position from the original position to reset the reset switch and then, is moved to the non-operating position, so that the connection between the operating member and the driving mechanism is released. The operating member which is moved to the non-operating position is held in the non-operating position, so that the unit never operates the reset switch again. Consequently, it is possible to accurately recognize the time for replacement, thereby making it possible to prevent the unit which has been used such a number of times that replacement is required from being used for a longer time than necessary, as in the above described embodiment.

Furthermore, in a preferred embodiment, the above described driving mechanism includes an endless gear member, and the above described operating member comprises a gear member with an end which is engaged with the endless gear member. In the present embodiment, it is possible to realize the irreversible movement of the operating member to the non-operating position by such simple construction that the gear member serving as the operating member is engaged with the endless gear member included in the driving mechanism.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

The embodiments will be described in detail with reference to the drawings.

Figure 4:
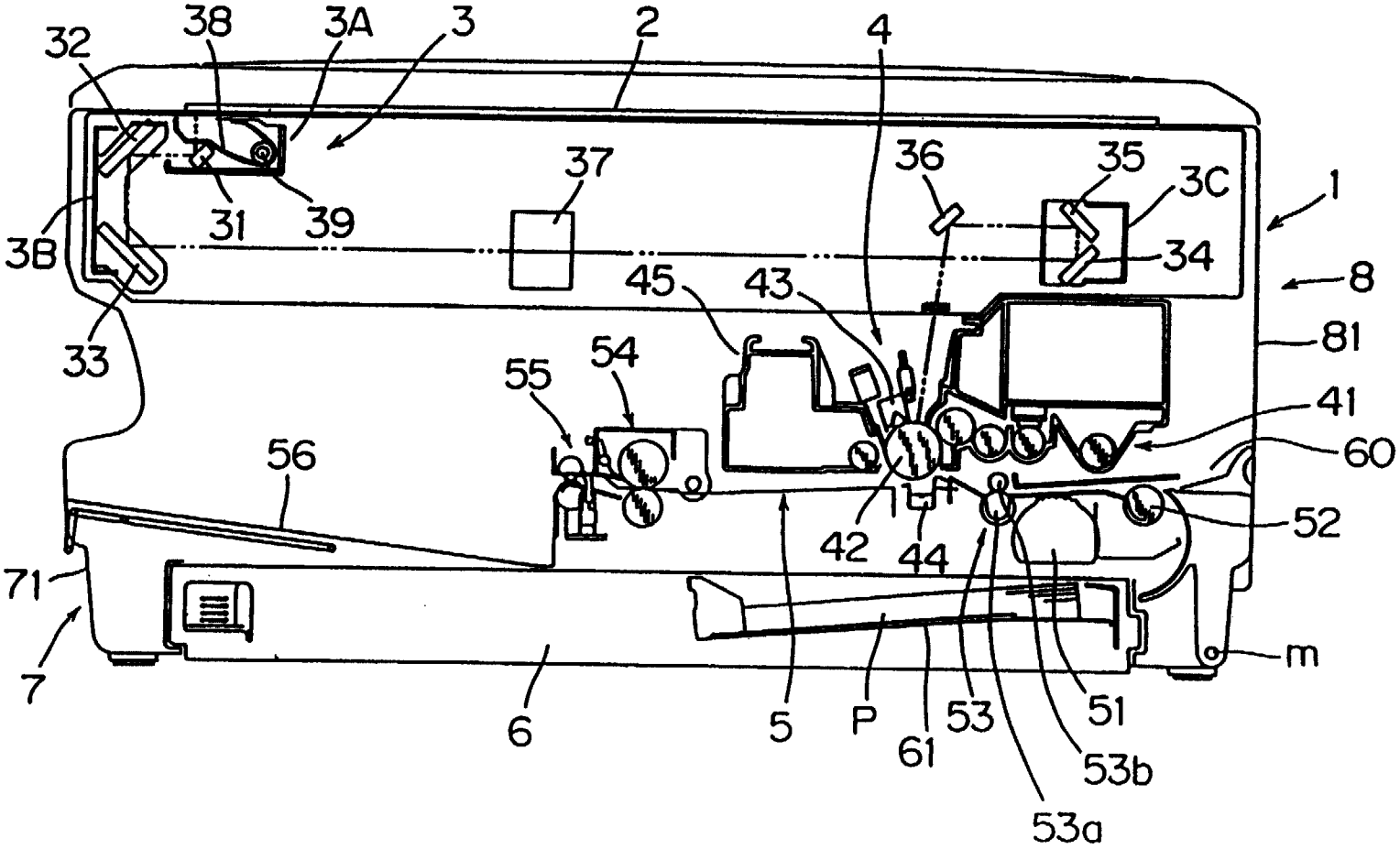
FIG. 4 is a schematic diagram showing the internal construction of a copying machine.

Referring to FIG. 4, the main body of a copying machine 1 comprises i) an optical system 3 for illuminating and scanning a document mounted on a transparent platen 2, to introduce reflected light from the document into a photosensitive drum 42, ii) an image forming section 4 for developing an electrostatic latent image formed on the photosensitive drum 42 into a toner image by a developing device 41 and then, transferring the toner image on paper sheets, iii) a paper conveying section 5 for pulling the above described paper sheets out of a paper feed tray 61 in a paper containing section 6 by a paper feed roller 51 which is semicircular in cross section, and discharge the paper sheets onto a discharge tray 56 in the main body of the copying machine 1 through the image forming section 4, and the like.

Figure 1:
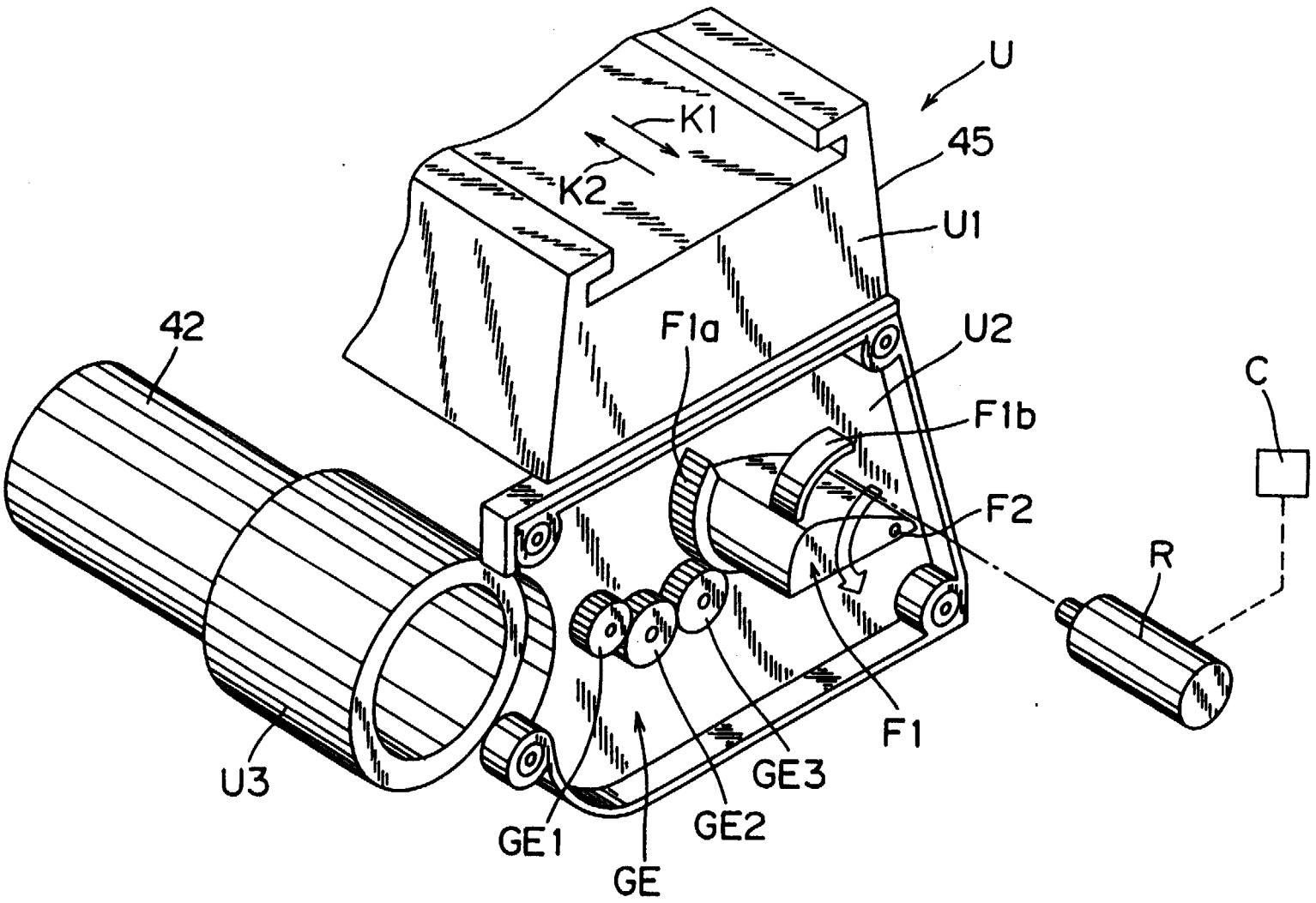
FIG. 1 is a schematic perspective view showing a reset mechanism of a counter for counting the number of times of image formation according to one embodiment of the present invention.

Referring now to FIG. 1, in this copying machine, if the number of times of image formation counted by a counter C reaches a predetermined value, a message issuing an instruction to replace a unit U constituting a part of the image forming section 4 is displayed on a display (not shown) in an operating section. A reset mechanism according to the present embodiment is characterized in that i) there is provided a gear member F1 serving as an operating member for resetting the counter C by depressing a reset switch R in synchronism with a mounting operation of the unit U on the main body of the copying machine 1, and ii) the gear member F1 is irreversibly moved to a non-operating position at the time of initially driving the unit U, so that the counter C is not reset if the unit U is mounted again.

Referring to FIG. 4, the main body of the copying machine 1 is one of a clamshell type comprising a lower unit 7 sectioned by a lower casing 71 and an upper unit 8. Upper unit 8 is on the lower unit 7 so as to be relatively rotatable around a predetermined axis of rotation m provided at an end of the lower unit 7. Upper unit 8 is sectioned by an upper unit 81 and so constructed as to be opened or closed by rotating the upper unit 8 relative to the lower unit 7.

The optical system 3 illuminates the document by a fluorescent lamp 39 with a reflecting plate 38, which are mounted on a first moving frame 3A. Optical system 3 introduces reflected light from the document to the photosensitive drum 42 sequentially through a first mirror 31 which is fixed to the first moving frame 3A, a second mirror 32 and a third mirror 33 which are fixed to a second moving frame 3B, a lens 37, a fourth mirror 34 and a fifth mirror 35 which are fixed to a third moving frame 3C, and a sixth mirror 36.

In the image forming section 4, a charging corona discharger 43, the developing device 41, a transferring corona discharger 44 and a cleaning device 45 are sequentially disposed around the photosensitive drum 42. The image forming section 4 is so constructed as to form a document image on an outer peripheral surface of the photosensitive drum 42 which has been uniformly charged by the charging corona discharger 43, to form an electrostatic latent image. The image forming section 4 then develops the electrostatic latent image into a toner image by the developing device 41, transfer the toner image onto paper sheets by the transferring corona discharger 44, and recovers the remaining toner by the cleaning device 45.

The paper conveying section 5 comprises the above described paper feed roller 51 for pulling paper sheets out of the paper feed tray 61 one at a time. It also has a delivery roller 52 for conveying the paper sheet from a manual paper feeding section 60 or the paper feed tray 61, driving roller means 53*a* and driven roller means 53*b* constituting registration means 53, against which the front end of the paper sheet conveyed by the delivery roller 52 abuts for causing the paper sheet to temporarily wait, a fixing section 54 for fixing the toner image transferred onto the paper sheet, and a pair of discharge roller means 55.

Referring to FIG. 1, the above described unit U comprises the photosensitive drum 42, the cleaning device 45 and the like. The unit U can be integrally inserted or removed into or from a predetermined portion of the main body of the copying machine 1 (in FIG. 1, the direction of insertion is indicated by an arrow K1, and the direction of removal is indicated by an arrow K2). A holding cylinder portion U3 for respectively holding both ends of the photosensitive drum 42 is provided at both ends in the direction of insertion or removal of a housing U1 in the unit U. In addition, a gear mechanism GE (including gears GE1, GE2 and GE3) serving as a driving mechanism for driving an agitating roller (not shown) in the cleaning device 45 is disposed in an end face portion U2 on the side of insertion of the housing U1 in the unit U.

The gear member F1 serving as the above described operating member is in the shape of a fan, and is supported by the end face portion U2 so as to be rotatable around an axis F2 disposed in the center of the fan. The gear member F1 has a fan-shaped gear portion F1*a* which is engaged with the gear GE3 on the most downstream side in the direction of torque transmission in the above described gear mechanism GE. Gear member F1 also has a projected piece portion F1*b* continuously extending in a curved shape in a clockwise direction to connect with a fan-shaped circular arc portion for pressing a reset switch R. The projected piece portion F1*b* is provided in a position where it does not interfere with the gear mechanism GE even if the gear member F1 is rotated.

Figure 2:
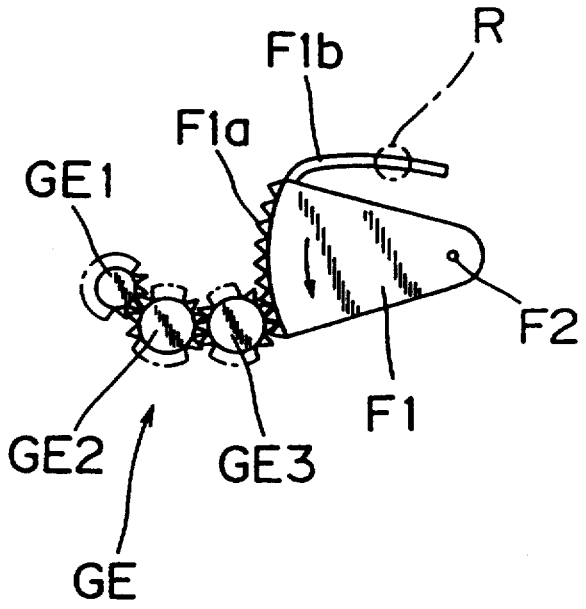
FIGS. 2 and 3 are diagrams sequentially showing operations of a gear member serving as an operating member.
Figure 3:
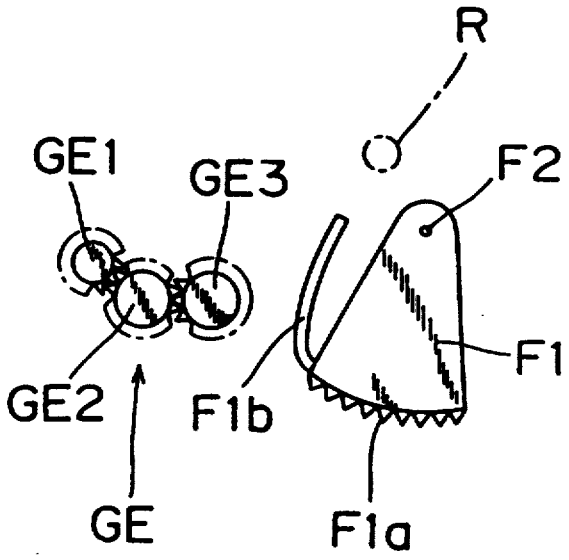

The gear member F1 is so constructed that it can operate the reset switch R by the projected piece portion F1*a* as the unit U is mounted on the main body of the copying machine 1 in an operating position where the projected piece portion F1*b* is approximately horizontal (see FIG. 2). The gear member F1 then is rotated in a counterclockwise direction by the gear mechanism GE so that it is moved to a non-operating position where it does not interfere with the reset switch R (see FIG. 3). The gear member F1 which is moved to the non-operating position once can be held at the non-operating position in the seating relationship by its own weight, which is possible by shifting the position of the center of rotation of the gear member F1 and the position of the center of gravity. The gear member F1 which is moved to the non-operating position once is never returned to the operating position.

In a unit which is not used at the time of shipment from a factory (a new unit), the above described gear member F1 is set in the operating position where it can operate the reset switch R through the above described projected piece portion F1*b* by adjusting the position where the fan-shaped gear portion F1*a* in the gear member F1 is engaged with the gear GE3. If a unit U which is not used is mounted on the main body of the copying machine 1, the gear member F1 in the operating position resets the reset switch R in synchronism with this mounting operation, to set the counter C for counting the number of times of image formation to zero. If the unit U is initially driven by image formation, the gear member F1 is irreversibly moved to the non-operating position, never to operate the reset switch R thereafter even if the unit U is mounted again.

According to the present embodiment, even if the unit U which has not been used such a number of times that replacement is required is removed for maintenance once and is mounted again, the counter can count the number of times of image formation thereafter in addition to the number of times of image formation counted before the removal, thereby making it possible to accurately recognize the time for replacement and therefore, to make it possible to prevent the unit U which has been used such a number of times that replacement is required from being used for a longer time than necessary.

Although in the embodiment shown in FIG. 1, the reset switch R is depressed by the projected piece portion F1*b* provided for by the gear member F1 at the time of mounting the unit U, the reset switch R may be depressed by an end face of the gear member F1. In this case, the necessity of the projected piece portion F1*b* can be eliminated.

Figure 5:
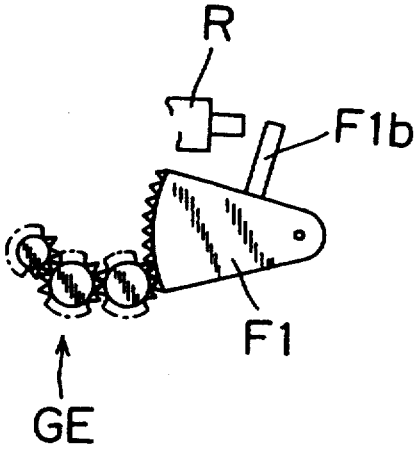
FIGS. 5 to 7 are diagrams sequentially showing operations of a gear member in a reset mechanism according to another embodiment of the present invention.
Figure 6:
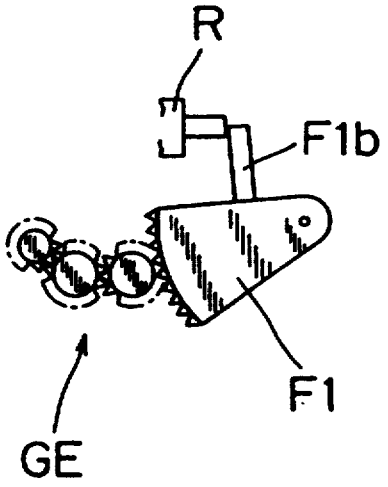
Figure 7:
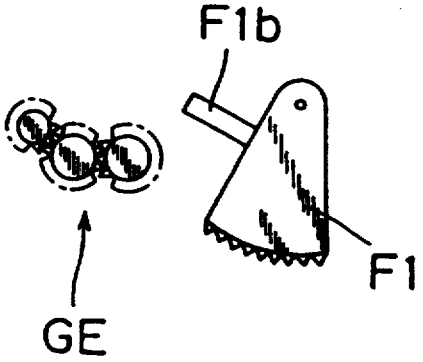

Furthermore, although in the embodiment shown in FIG. 1, the reset switch R is operated in synchronism with the mounting operation of the unit U, the counter C can be reset at the time of initially driving the unit U by disposing the reset switch R in the moving track of the projected piece portion F1*b* as shown in FIGS. 5 to 7. In this case, the state shown in FIG. 5 (corresponding to FIG. 2) of the gear member F1 is the original position set at the time of shipment from a factory, and the state shown in FIG. 7 (corresponding to FIG. 3) is the non-operating position. In addition, a predetermined state during the rotation of the gear member F1 from the original position to the non-operating position (see FIG. 6) is the operating position where the reset switch R is operated.

Figure 8:
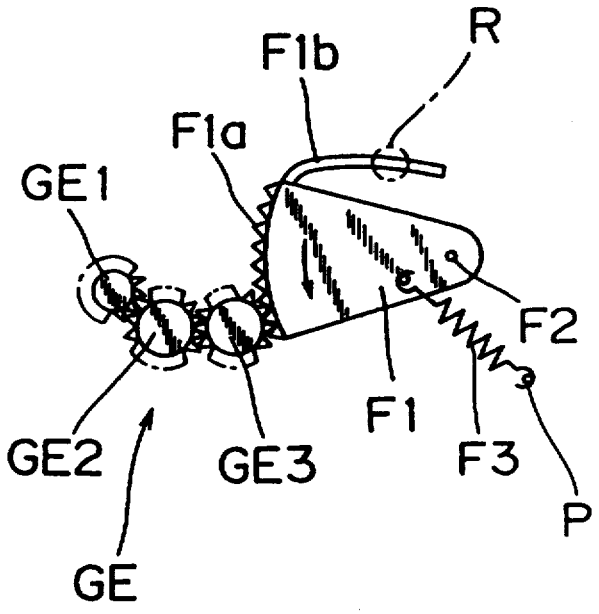
FIG. 8 is a schematic side view showing a gear member and a tension coil spring for urging the gear member to a non-operating position in still another embodiment of the present invention.

As an elastic member can be used for urging the gear member F1 to the non-operating position. For example, as shown in FIG. 8, a tension coil spring F3 having one end hung on a predetermined portion of the gear member F1 and the other end hung on a pin P projected in the end face portion U2 in the unit U can be used. A compression coil spring or a torsion spring may also be used.

In addition thereto, various design changes can be made within the range in which the gist of the present invention is not changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A reset mechanism for a counter mounted on an image forming apparatus, said reset mechanism being integral with a unit constituting at least a part of an image forming section for image formation which is detachably mountable on the image forming apparatus, said reset mechanism comprising:

a driving mechanism for driving said unit;

an operating member movable from an operating position to a non-operating position, said operating position being a position where said operating member operates a reset switch of the counter when said unit is mounted on the image forming apparatus, and said non-operating position being a position where interference between said operating member and the reset switch is avoided, said operating member being in said operating position before said unit is used; and said operating member being connected to said driving mechanism such that said operating member is moved from said operating position to said non-operating position by an initial driving of said unit by said driving mechanism and the connection of said operating member to said driving mechanism is released such that said operating member is not restorable to said operating position.

2. A reset mechanism according to claim 1, wherein said operating member is provided at an end face portion of a housing for said unit.

3. A reset mechanism according to claim 1, wherein said driving mechanism includes an endless gear member, and said operating member includes a gear member with an end which is engaged with said endless gear member when said operating member is in said operating position.

4. A reset mechanism according to claim 1, wherein after said operating member is moved to said non-operating position, said operating member is maintained at said non-operating position by the weight of said operating member.

5. A reset mechanism according to claim 1, further including holding means for holding said operating member in said non-operating position after said operating member is moved to said non-operating position.

6. A reset mechanism according to claim 5, wherein said holding means includes an elastic member for urging said operating member to said non-operating position.

7. A reset mechanism for a counter mounted on an image forming apparatus, said reset mechanism being integral with a unit constituting at least a part of an image forming section for image formation which is detachably mountable on the image forming apparatus, said reset mechanism comprising:

a driving mechanism for driving said unit;

an operating member movable from an original position to a non-operating position through an operating position where said operating member operates a reset switch of the counter, said original position being a position at which said operating member is located before said unit is used, and said non-operating position being a position where interference between said operating member and the reset switch is avoided;

said operating member being connected to said driving mechanism such that said operating member is moved from said original position to said non-operating position by an initial driving of said unit by said driving mechanism and the connection of said operating member to said driving mechanism is released such that said operating member is not restorable to said operating position.

8. A reset mechanism according to claim 7, wherein said operating member is provided at an end face portion of a housing for said unit.

9. A reset mechanism according to claim 7, wherein said driving mechanism includes an endless gear member, and said operating member includes a gear member with an end which is engaged with said endless gear member when said operating member is in said original position.

10. A reset mechanism according to claim 7, wherein after said operating member is moved to said non-operating position, said operating member is maintained at said non-operating position by the weight of said operating member.

11. A reset mechanism according to claim 7, further including holding means for holding said operating member in said non-operating position after said operating member is moved to said non-operating position.

12. A reset mechanism according to claim 11, wherein said holding means includes an elastic member for urging said operating member to said non-operating position.

* * * * *